US005315955A

United States Patent [19]

Feliz

[11] Patent Number: 5,315,955

[45] Date of Patent: May 31, 1994

[54] FLAGPOLE SILENCERS

[76] Inventor: Jack M. Feliz, 2110 Southridge Dr., Palm Springs, Calif. 92264

[21] Appl. No.: 991,464

[22] Filed: Dec. 16, 1992

[51] Int. Cl.[5] ..... G09F 17/00

[52] U.S. Cl. ..... 116/173

[58] Field of Search ..... 116/173, 174; 24/135 N

[56] References Cited

U.S. PATENT DOCUMENTS

| | | | |
|---|---|---|---|
| 119,292 | 9/1871 | Albert | 116/173 |
| 394,983 | 12/1888 | Hurley | 116/173 |
| 538,075 | 4/1895 | Herrberg | 24/135 N |
| 559,443 | 5/1896 | Duhy | 24/135 N |
| 1,324,439 | 12/1919 | Walpuski et al. | 116/173 |
| 1,547,416 | 7/1925 | Edwards | 116/173 |
| 1,746,090 | 2/1930 | Rechter | 24/135 N |
| 1,882,167 | 10/1932 | Thirlwell | 24/135 N |
| 2,493,855 | 1/1950 | Bucks | 116/173 |

*Primary Examiner*—William A. Cuchlinski, Jr.
*Assistant Examiner*—W. Morris Worth
*Attorney, Agent, or Firm*—Harris, Wallen, MacDermott & Tinsley

[57] ABSTRACT

Flagpole noise silencers are comprised of flag halyard fender rings or brackets and resiliently banded flag retainer hooks that will prevent the wind driven halyards and flag retainer hooks from striking the flagpole thus eliminating an undesirable source of noise pollution.

4 Claims, 3 Drawing Sheets

FLAGPOLE SILENCERS

BACKGROUND OF INVENTION

This invention relates to the elimination of two sources of noise that are generated by flagpole halyards and metal flag retainer hooks that repeatedly strike flagpoles during windy periods. This nerve wracking noise is forced upon millions of people daily, in schools, government buildings, military installations, private enterprises, and seagoing vessels, etc. Noise pollution is reported as being detrimental to health, and this invention will help reduce health problems.

SUMMARY AND OBJECTS OF INVENTION

In summary, the chief aim of my invention is to provide simple devices that will eliminate the above mentioned noise pollution problems, in addition to providing other amenities as will be noted henceforth. Another aim of my invention is to provide a first device comprised of fender rings for use on wooden flagpoles and fender brackets for use on metal flagpoles. The rings and brackets are secured to the flagpole and will position the flag halyard at a suitable distance from the flagpole to prevent the intense vibrations of the halyard from striking the flagpole during windy periods, thereby eliminating one of the common causes of noise pollution emanating from flagpoles. The upper ring or bracket is secured to the top of the flagpole and supports the flag halyard pulley. In some situations where a two halyard flag hoist is required, an additional flag halyard pulley may be secured to the opposite side of the ring. The middle ring or bracket is extended a greater distance from the flagpole than the upper or lower rings or brackets to provide a bow string effect so that the halyard can be pulled taut and eliminate any vibration on the said middle ring or bracket and keep the halyard from striking the flagpole. On very tall flagpoles located in excessively windy areas, it may be necessary to install two or more fender rings or brackets equally spaced between the top and bottom of the flagpole to prevent the halyard from striking the flagpole. The lower ring or bracket is secured to the lower end of the flagpole and supports a cleat to secure the flag halyard thereon. The fender rings are seamless and are installed over the top of the flagpole, however, they could be cut for direct installation and a suitable clamp secured thereon to make a solid ring.

Another aim of my invention is to provide a second device that will eliminate the principle noise maker which is the metal flag retainer hooks that repeatedly strike the flagpole with vigor while either in an upper flag flying position or in the lowered position after the flag has been unhooked and the halyard is secured to the cleat. The above mentioned noise creating metal hooks will be substituted for a soundless pair of resiliently banded flag retainer hooks. On short flagpoles where the wind does not have the excessive vibrating effect on the halyard striking the flagpole, the resilient flag hooks should eliminate any noise emanating from the flagpole. The use of resilient hooks on all flag poles are beneficial when the halyard becomes sufficiently slack to permit the flag hooks to be blown toward the flagpole thereby striking the pulley support structure. If this condition would occur with metal hooks the striking noise would be telegraphed to the flagpole and thereby amplified.

Another aim of my invention is to greatly reduce the cost and frequency of flagpole maintenance. The continued striking of the flag halyards and metal flag retainer hooks soon remove the paint from the flagpole thereby exposing the base metal or wood to the elements. The maintenance of wooden and steel flagpoles are a very costly procedures, so consequently the maintenance is often delayed. It is quite common to observe steel flagpoles where rust has emerged and discolored the adjacent painted areas, thereby creating a rusty eyesore. It will be noted from the foregoing that this invention will contribute considerably to the betterment of health, economy and aesthetic values in association with flagpoles.

The foregoing objects, advantages, features and results of the present invention together with various other objects, advantages, features and results thereof which will be evident to those skilled in the art to which the invention relates in the light of this disclosure, may be achieved with the exemplary embodiments of the invention illustrated in the accompanying drawings and described in detail hereafter.

DESCRIPTION OF EXEMPLARY EMBODIMENTS OF THE INVENTION

Figure 1:
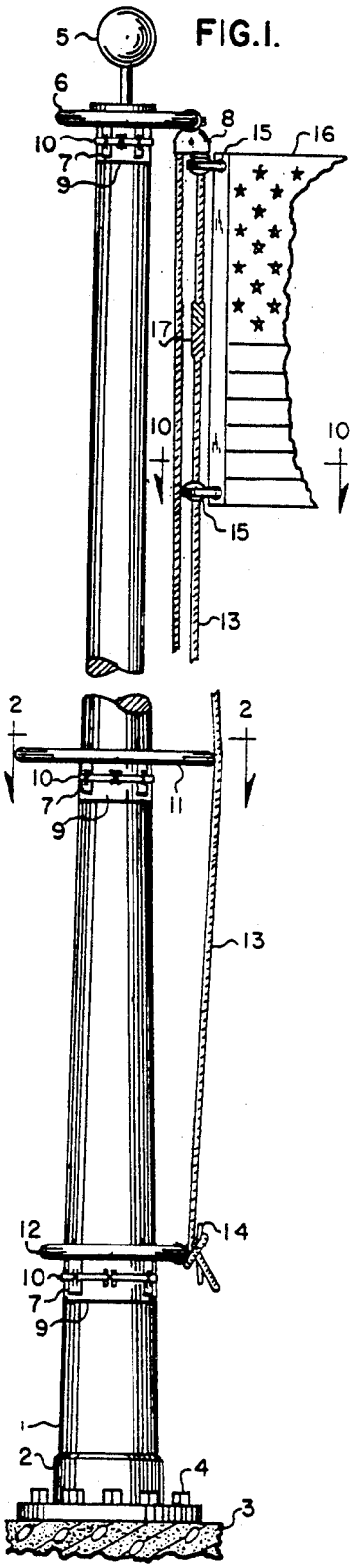
FIG. 1 is a side elevational view of the present invention, illustrating a wooden flagpole with noise eliminating fender rings and resilient banded flag retainer hooks.
Figure 2:
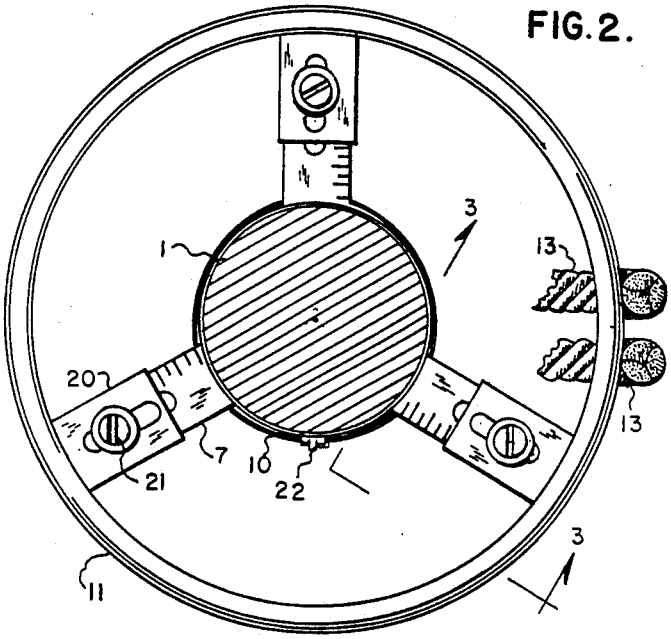
FIG. 2 is an enlarged horizontal section taken as indicated along the angled arrows 2—2 of FIG. 1, illustrating the adjustable brackets slidably engaged to the fender ring and flagpole.
Figure 3:
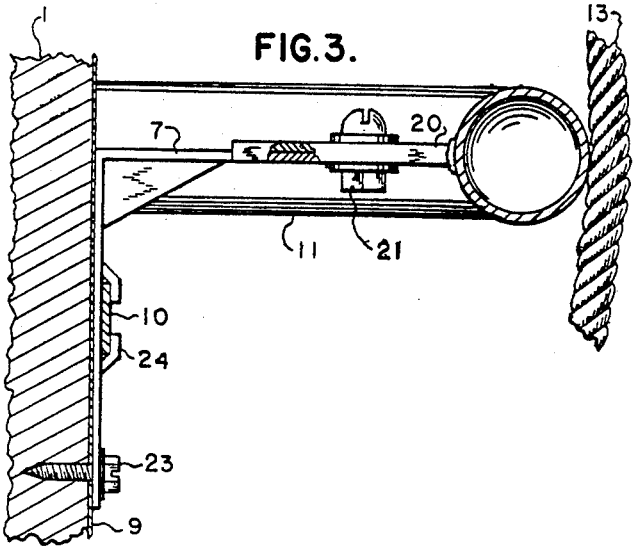
FIG. 3 is an enlarged fragmentary vertical section taken as indicated along the angled arrows 3—3 in FIG. 2, illustrating an adjustable bracket and the means for securing the bracket to the wooden flagpole.
Figure 4:
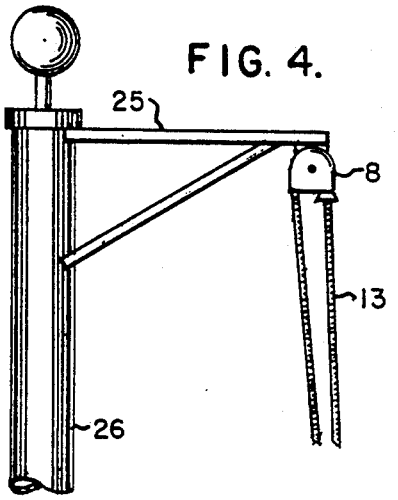
FIG. 4 is a fragmentary side elevational view of a fixed fender bracket supporting a flag hoist pulley. The bracket is suitable for welding to the top of metal flagpoles.
Figure 5:
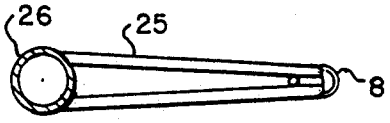
FIG. 5 is a fragmentary plan view of FIG. 4.
Figure 6:
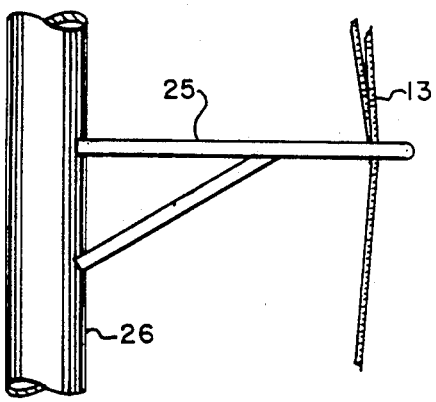
FIG. 6 is a fragmentary side elevational view of a fixed fender bracket for use in fending the flag halyard away from the flagpole. The bracket is suitable for welding to the middle of metal flagpoles.
Figure 7:
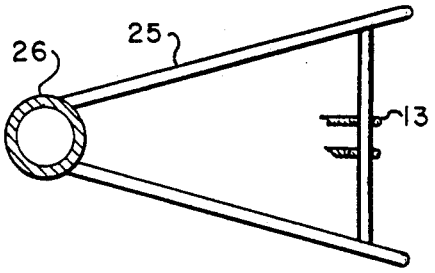
FIG. 7 is a fragmentary plan view of FIG. 6.
Figure 8:
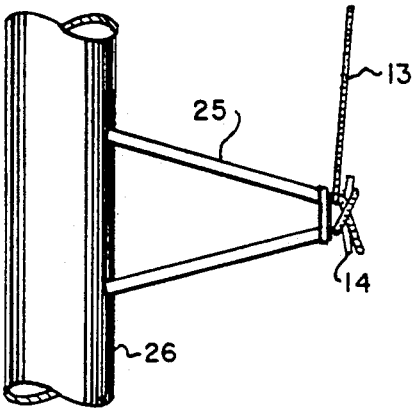
FIG. 8 is a fragmentary side elevational view of a fixed fender bracket for use in supporting a cleat for securing the flag halyard thereto. The bracket is suitable for welding to the lower end of metal flagpoles.
Figure 9:
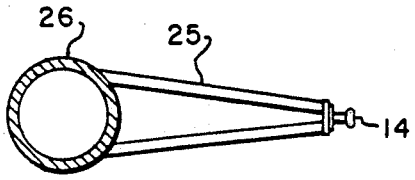
FIG. 9 is a fragmentary plan view of FIG. 8.
Figure 10:
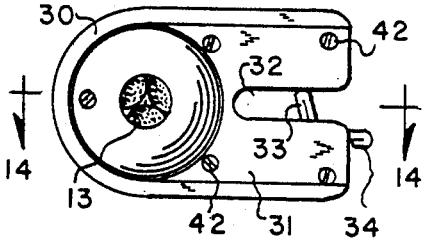
FIG. 10 is an enlarged plan view taken as indicated along the angled arrows 10—10 in FIG. 1, illustrating a resiliently banded flag retainer hook.
Figure 11:
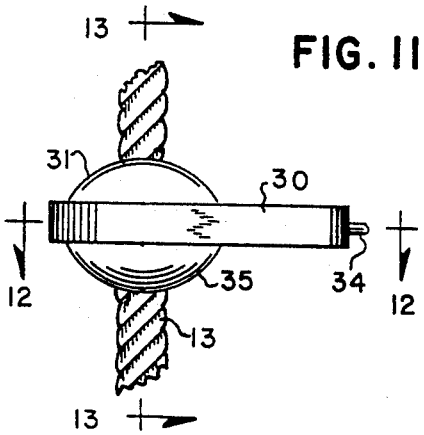
FIG. 11 is a side elevational view of FIG. 10 illustrating the configuration of the resilient retainer hook and its relation to the flag halyard.
Figure 12:
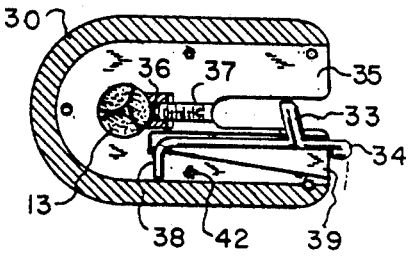
FIG. 12 is a horizontal section taken as indicated along the angled arrows 12—12 of FIG. 11 illustrating the resilient band, adjustable halyard clamp and the flag retaining hook.
Figure 13:
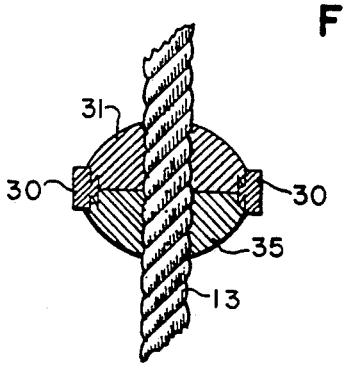
FIG. 13 is a vertical section taken as indicated along the angled arrows 13—13 of FIG. 11, illustrating the upper and lower halves of the flag hook casing and the means of retaining the dove tailed resilient band in the dove tailed configurations of the two casing halves.
Figure 14:
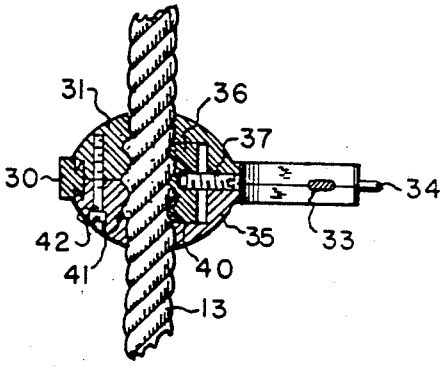
FIG. 14 is a vertical section taken as indicated along angled arrows 14—14 of FIG. 10, illustrating the adjustable halyard clamp, lands and grooves in the casing halves and halyard clamp to secure the flag retainer hook to the halyard, and the resilient band.

Referring to FIG. 1 of the drawings, the wooden flagpole 1 is secured to a metal sleeve 2, the latter is secured to a concrete base 3 as by bolts 4. A masthead ball 5 is secured to the top of the flagpole, a fender ring 6 is secured to brackets 7, a flag hoist pulley 8 is flared to receive the convex surface of the upper half of the resilient flag hook, thereby reducing the chafing of the flag halyard. The adjustable brackets 7 are superimposed on an overlapping band of sheet metal 9 which prevents the brackets 7 from being forced into the wooden flagpole by the "BAND-IT" strap 10 that secures the brackets to the flagpole. The fender ring 11 is secured midway between the upper ring 6 and the lower ring 12 for the purpose of preventing the wind blown halyard 13 from striking the flagpole. In excessively windy areas it may be necessary to install two or more fender rings 11 to counteract the wind force. The middle ring 11 is larger in diameter than the upper ring 6 and the lower ring 12 to create a bow string effect so that the halyard can be pulled taut and eliminate any vibration on the said ring and to keep the halyard well clear of the flagpole. The lower ring 12 supports a cleat 14 to secure the flag halyard 13 thereto. A pair of resiliently banded flag retaining hooks 15 are clamped to the flag halyard 13. The flag retaining hooks in turn are secured to the flag 16. A splice 17 provides an endless halyard 13. FIGS. 2 and 3 illustrate the adjustable brackets 7 which are slidably engaged into the receiving bracket 20 which is secured to the fender ring 11, a bolt 21 secures the brackets 7 and 20 from any movement. The top of bracket 7 is graduated for easy reference in centering the ring 11 to the flagpole 1. The principle purpose of the adjustable brackets 7 is for all three fender rings to be able to fit one size ring to several different diameter flagpoles. The fender rings 6 and 12 are similarly constructed. The tension on the "BAND-IT" strap 10 is maintained by the locking clamp 22. The strap 10 is secured to the bracket 7 by retainer guides 24. A screw 23 is screwed into the wooden flagpole 1 to provide additional support for the bracket 7. FIGS. 4, 6 and 8 are side elevational views of fixed brackets 25 for use on metal flagpoles 26. FIGS. 5, 7 and 9 are plan views of FIGS. 4, 6 and 8 respectively. The fixed brackets 25 in FIGS. 4, 6 and 8 serve the same purpose as mentioned above for the fender rings 6, 11 and 12 respectively in FIG. 1. The brackets 25 in FIGS. 4, 6 and 8 are constructed from metal rod or tubing and welded to the flagpole 26. The fixed brackets 25 could be banded to the wooden and metal flagpoles by providing suitable footing secured to the base of the fixed brackets, with suitable screw holes in the footings to provide additional holding power (not shown). There are several advantages of the fixed brackets in that they are more economical to manufacture and will fit most common sizes of flagpoles. FIG. 10 is a plan view of the resiliently banded flag retainer hook showing the resilient band 30. The band 30 could be constructed of neoprene or other highly resistant materials to the sun and airborne chemicals with excellent shock absorbing qualities and a long life expectancy. The retainer case 31 shows a groove 32 and a spring hook 33 for receiving and retaining the flag and grommet. The spring hook 33 is provided with an integral release handle 34 for releasing the flag and grommet. FIG. 11 shows the upper and lower cases 31 and 35 assembled with the resilient band 30 surrounding the said cases and the halyard 13 passing through the said cases. The convex surfaces of the cases 31 and 35 adjacent to the halyard serve two purposes in that they contain the halyard clamping means and they also act as fenders when the flag is hoisted or lowered over the fender ring 11 of FIG. 1 and the fender bracket of FIGS. 6 and 7. FIG. 12 shows the lower half of the casing 35, with a cross section of the resilient band 30, halyard 13, spring hook 33, halyard clamp 36 and clamp adjusting screw 37. The inboard end of screw 37 is provided with an annular groove for the insertion of a retainer pin through the clamp 36 to prevent the clamp 36 from falling out of the casing when not secured to the halyard. The lower half of the case 35 also provides a groove 38 for anchoring the spring hook 33 and further provides a tapered groove 39 to permit the spring hook to travel to its maximum opening for releasing the flag grommet and flag. The hook portion of spring hook 33 is angled back towards the halyard to assist retention of the flag grommet and also to facilitate the insertion of the flag grommet when connecting the flag to the hook. FIG. 13 shows the dovetailed portions of the upper and lower cases 31 and 35 which retain a similar shaped dovetailed inner surface of the resilient band 30. FIG. 14 shows the side view of the halyard clamp 36 which is provided with the lands and grooves 40 for engaging the halyard 13, it is also noted that the surfaces of the upper and lower cases 31 and 35 adjacent to the halyard are provided with lands and grooves 41 for receiving the halyard as the clamp 36 is forced onto the halyard thereby increasing the holding power of the clamp 36. The two halves of the casing 31 and 35 are held together by screws 42. These screws permit replacement of any deteriorated parts. The casing halves could be constructed of "Delrin" or other highly resistant material to the sun, salt spray and airborne chemicals. It would be highly desirable to construct all of the metal parts from brass or stainless steel.

Although only one exemplary embodiment of the invention has been disclosed herein for the purpose of illustration, it will be understood that various other changes, modifications and substitutions may be incorporated without departing from the spirit of the invention as defined by the claims which follow.

I claim as my invention:

1. In a flagpole silencer for a flagpole having a top, a bottom and a flag hoist halyard, the combination of:

(a) a top fender bracket for securing to the top of the flagpole;

(b) said top fender bracket supporting a flag hoist pulley;

(c) said top fender bracket and attached flag pulley positioned at a suitable distance from the flagpole to prevent the flag hoist halyard from striking the flagpole during windy periods;

(d) a means of securing said top fender bracket to the flagpole;

(e) a middle fender bracket for securing midway between the top and bottom of the flagpole thus preventing the halyard from striking the flagpole;

(f) a bottom fender bracket for securing near the bottom of the flagpole and supporting a cleat for securing the flag halyard in a fixed position;

(g) said bottom fender bracket and attached cleat positioned at a suitable distance from the flagpole to prevent the flag halyard from striking the flagpole during windy periods;

(h) said middle fender bracket maintains the halyard a greater distance from the flagpole than said top and bottom fender brackets thus creating a bow string effect so that the halyard can be pulled taut and secured at said cleat thereby preventing vibration of the halyard on said middle fender bracket and keeping the halyard well clear of the flagpole.

2. In a flagpole silencer for use with a flag having grommets, and a flag hoist halyard, the combination of:

(a) a retainer case having retainer casing halves with a central passage for a halyard and a groove for a flag grommet;

(b) a resilient band, said casing halves and said band having interengaging surfaces for joining said casing halves and band;

(c) a flag retainer carried in said retainer case;

(d) said flag retainer is provided with a rearward slanting spring hook projecting into said groove to facilitate insertion of the flag grommet into said groove and to provide additional flag grommet retention capabilities;

(e) said spring hook is provided with an anchor means at one end for anchoring said spring hook in said retainer case and the opposite end is provided with a flag grommet release handle;

(f) said flag retainer is provided with a halyard clamp to prevent shifting on the halyard; and (g) said central passage of said retainer case contains the halyard clamp securing the silencer to the halyard.

3. A flagpole silencer as defined in claim 1 wherein each of said top, middle and bottom fender brackets is fixed in position.

4. A flagpole silencer for use with a flag having grommets, and a flag hoist halyard, as defined in claim 1, including:

(a) a retainer case having retainer casing halves with a central passage for a halyard and a groove for a flag grommet;

(b) a resilent band, said casing halves and said band having interengaging surfaces for joining said casing halves and band;

(c) a flag retainer carried in said retainer case;

(d) said flag retainer is provided with a rearward slanting spring hook projecting into said groove to facilitate insertion of the flag grommet into said groove and to provide additional flag grommet retention capabilities;

(e) said spring hook is provided with an anchor means at one end for anchoring said spring hook in said retainer case and the opposite end is provided with a flag grommet release handle;

(f) said flag retainer is provided with a halyard clamp to prevent shifting on the halyard; and (g) said central passage of said retainer case contains the halyard clamp securing the silencer to the halyard.

* * * * *